United States Patent [19]

Kane

[11] 4,343,054

[45] Aug. 10, 1982

[54] SOFA BED COMBINATION

[76] Inventor: Dan S. Kane, 1329 Lombard St., Apt. 111, Philadelphia, Pa. 19147

[21] Appl. No.: 116,127

[22] Filed: Jan. 28, 1980

[51] Int. Cl.[3] ..... A47C 17/13; A47C 17/37

[52] U.S. Cl. ..... 5/18 R; 5/3

[58] Field of Search ..... 5/2 R, 3, 12 R, 17, 5/18, 37 C

[56] References Cited

U.S. PATENT DOCUMENTS

| | | | |
|---|---|---|---|
| 2,377,958 | 6/1945 | Mann | 5/12 R |
| 2,639,441 | 5/1953 | Vakassian | 5/18 R |
| 4,166,299 | 9/1974 | Du Shane et al. | 5/18 R |

FOREIGN PATENT DOCUMENTS

| | | | |
|---|---|---|---|
| 277507 | 4/1969 | Austria | 5/18 R |
| 1092464 | 4/1955 | France | 5/18 R |

*Primary Examiner*—Alexander Grosz

*Attorney, Agent, or Firm*—Thomas H. Murray; Clifford A. Poff

[57] ABSTRACT

A floor-supported sofa frame has a bolster support back adjoined with end walls which are further interconnected by a crossplate enclosing an area containing a cushion support member spaced above the floor. The space between the cushion support member and the floor defines a storage area wherein a floor-supported trundle bed is removably housed for withdrawal to form a lateral extension of the cushion support member. The trundle bed defines a bolster support surface to receive two bolster members that normally form a back cushion for a sofa by superimposed positioning into a face-to-face arrangement. The bolster members are hinged together and have a thickness such that, when positioned side-by-side on the trundle bed, there is formed an extension to the sofa cushion and thereby forming a bed. The bolster members, sofa frame and trundle bed are usable separately as beds and combined as a sofa with the trundle bed usable separately.

11 Claims, 5 Drawing Figures

SOFA BED COMBINATION

BACKGROUND OF THE INVENTION

This invention relates to an article of furniture for use as a sofa and for conversion into a bed, and more particularly the present invention relates to the use of bolster members constructed to form a back cushion for a sofa and to form part of a bed by an adjoined relation with the cushion of the sofa while supported by a trundle bed that is storable within an area defined within the frame of the sofa.

The concept of converting a sofa for use as a bed is known in the art. One well known arrangement of parts provides that a mattress member be folded on a hinged frame to achieve folding of the mattress on itself for storage in the lower part of the sofa frame. Cushions are placed on top of the folded mattress and frame structure to form seat surfaces for the sofa configuration. The weight of a conventional sofa-bed combination is generally excessive and cannot be conveniently disassembled for greater ease then transporting the assembly. Another disadvantage of the conventional sofa-bed combination is that it is expensive to manufacture and all parts do not have alternative functions which suggest less than optimal economy in the end of space. Lack of comfort is also an inherent characteristic of conventional sofa-bed combinations. Moreover, considerable effort is required to operate the hinged frame for the mattress for conversion into a bed. The amount of effort tends to increase as the frame rusts and/or original lubrication is displaced through normal use so that maintenance can become a factor. Also, sheer number of moving parts (ergo, connectors and/or connections between parts) dictates high probability of breakage and so, any propensity for "planned obsolescence" is easily implemented by cost-conscious manufacturers in this fiercly competitive and largely unregulated (in terms of design detailing and human engineering) industry. This is partly due to the basic design concept which dictates that the entire weight of the mattress must be raised above a front cross member of the sofa frame, moved over it and then lowered for proper positioning of the mattress above the front cross member of the sofa.

SUMMARY OF THE INVENTION

It is an object of the present invention to provide a sofa-bed combination embodying greatly simplified construction and state of the art human engineering. Bolster members are used to form the back cushion of the sofa and/or part of a mattress when converted to a bed configuration, and wherein the parts further include a trundle-bed structure that is removable from a storage area within the sofa to support the bolster members.

More particularly, according to the present invention, there is provided a sofa-bed combination comprising a floor-supported sofa frame including a bolster member support surface adjoined with spaced-apart end walls that are further interconnected by a front crossplate enclosing an area containing cushion support means secured to the sofa frame above the floor thereby forming a static structure, a cushion carried by the cushion support means, the space between the cushion support means and the floor defining a storage area, a floor-supported trundle bed having a horizontal support surface receivable within the storage area for withdrawal therefrom to form a lateral extension to the cushion support means, and two bolster members adapted to form a sofa back cushion by superimposed positioning into a face-to-face arrangement for support by the sofa frame, the two bolster members being dimensioned for side-by-side support by the trundle bed to define an extension to the sofa cushion and thereby forming a bed.

In the preferred aspect of the present invention, the sofa-bed combination further includes a hinge means to join the bolster members together for the superimposed positioning and for the side-by-side positioning thereof. One of the bolster members preferably includes an anchor in the form of a tongue-and-groove section extending along an edge thereof for receiving the front crossplate of the sofa and forms an interlocked relation therewith. The sofa cushion is dimensioned for movement along the cushion support means away from the crossplate for access thereto for interlocking engagement with the anchor of the bolster member.

The present invention further provides that the bolster support surface is divided and hinged to permit repositioning of an upper part thereof to form a table surface in the bed configuration of the sofa frame. Latch members provide releasable support for the part forming the table surface.

BRIEF DESCRIPTION OF THE DRAWINGS

These features and advantages of the present invention as well as others will be more fully understood when the following description is read in light of the accompanying drawings, in which:

As shown in FIGS. 1, 3 and 4, the sofa-bed combination according to the present invention essentially includes a floor-supported sofa-bed frame 10 and a floor-supported trundle-bed frame 11. The major constructional components of the sofa frame are preferably made from standard industrial panel products and include a back wall 12 joined at right angles to end walls 13 and 14 through the use of structural angle members 15, only one of which is shown, and screw fasteners designed for use with standard industrial panel products. The same form of angle members and fasteners is used to interconnect the end walls 13 and 14 with a front crossplate 16. The crossplate 16 has a narrow width and it is secured at an elevation to extend above and parallel with the floor. A cushion support 17 is carried by elongated light-weight aluminum angle members 18, one of which is supported by the back wall 12 and the other of which is supported by the front crossplate 16. The floor 17 forms a cushion support surface that receives, as shown in FIGS. 3 and 4, a cushion 19. The thickness of the sofa-bed cushion 19 and the elevation at which it is supported by floor 17 are chosen so that the exposed upper surface of the cushion is at the conventional height of a sofa seat surface and a convenient height for a standard double bed. The length of the cushion 19 essentially corresponds to the distance between end walls 13 and 14 which defines the width of a conventional king-size mattress and the length of a conventional double mattress. However, the depth of the cushion is slightly less than the distance between back wall 12 and front crossplate 16 and the depth of the cushion is substantially greater than the depth of a conventional sofa seat in order to support cushions in the form of bolster members 21 and 22. The top of the cushion 19 is partly covered by arranging the two bolster members in a face-to-face relation as shown in FIG. 4 with the resulting exposed portion of the top of cushion 19 corresponding to a standard depth for a sofa.

Figure 3:
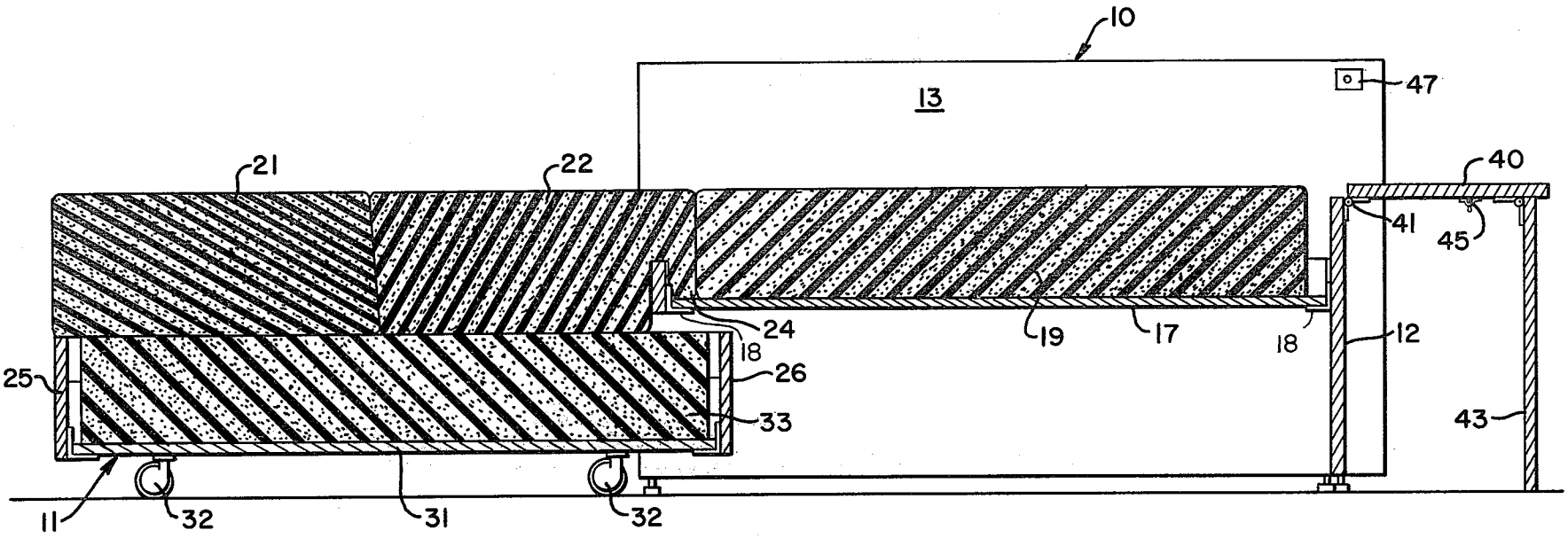
FIG. 3 is an elevational view, in section, of the arrangement of the parts shown in FIG. 1 in a bed configuration and with the bolster members included.

Each bolster member 21 and 22 includes a rhomboid slab of resilient furniture-grade material encased by a furniture-grade covering. The two bolster members are joined together by a fabric hinge 23 that extends along edge surfaces at the upper corner of their mating faces when in the position shown in FIG. 4. The thickness of each bolster member is the same and the aggregate of the thickness of the bolster members when supported upon the sofa cushion against the back 12 reduces the exposed area of the sofa seat so that it now corresponds to the conventional depth of a sofa seat cushion top surface. The bolster members are supported at a kinesiologistically acceptable angle resulting from their rhomboid shape and rest on the top surface of cushion 19. The height of each bolster member 21 and 22 in the configuration used to provide a sofa is about ½ the depth of the cushion 19 and 33 whereby, when the bolster members are repositioned about hinge 23 into an end-to-end relation, the surface area occupied by the bolster members essentially corresponds to the surface area occupied by the sofa cushion 19 and 33. Given that the bolster members extend between end walls 13 and 14, the bolster members 21 and 22 are used not only to form the sofa back but also to form half of a king-size bed arrangement wherein these members are supported by the trundle-bed frame 11. The arrangement of parts to form such a trundle-bed frame is shown in FIG. 3 in which it will be observed that the bolster member 22 has a longitudinal tongue 24 that is fitted behind the front crossplate 16. The space required to accommodate tongue 24 in its interlocking relation with the front crossplate is obtained by shifting the sofa cushion 19 until it abuts the back wall 12, thus insuring fixed positioning of the cushion 19.

The frame 11 forming part of a trundle bed essentially includes front and back walls 25 and 26, respectively, that are interconnected by spaced-apart end walls 27 and 28. The walls 25 and 26 support angle members 30 that, in turn, carry a trundle bottom wall 31. Attached to the underside of the frame 11 are spaced-apart unidirectional wheel assemblies 32. The top surface of the floor 31 supports a spacer assembly and/or mattress in the form of cushion 33. The top surface of the cushion 33 defines a bolster-bed support surface upon which the bolster members 21 and 22 are carried after the trundle bed is positioned to form a lateral extension of the floor 17 but at a different elevation. The difference between the elevation of the top surface of the cushion 33 and the floor 17 is compensated for by the thickness of the bolster members which is greater than the thickness of the sofa cushion 19.

Figure 4:
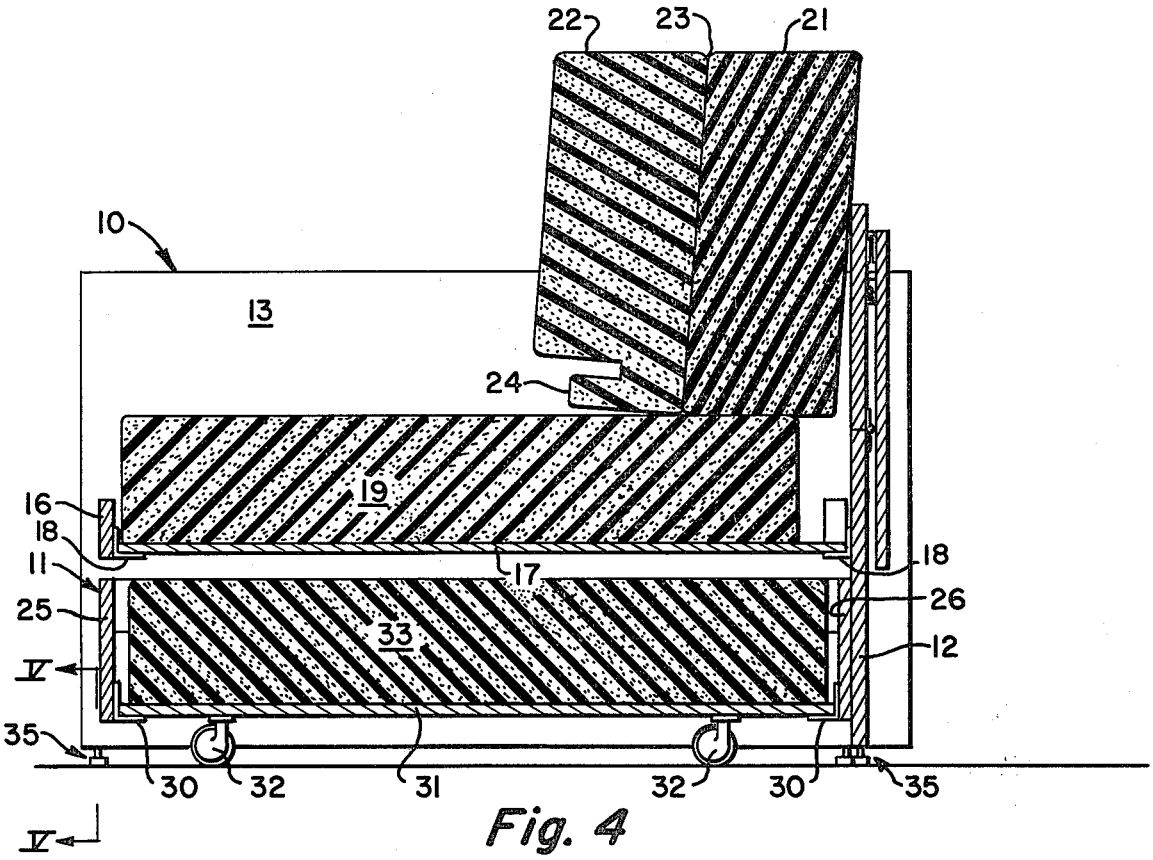
FIG. 4 is an elevational view, in section, but illustrating the arrangement of the parts in FIG. 3 in a sofa configuration.

As shown in FIG. 4, the trundle-bed frame 11 is received within a storage area defined below the floor 17 between end walls 13 and 14 and back wall 12. The front crossplate 16 of the sofa and front wall 25 of the trundle bed are essentially coplanar when positioned as shown in FIG. 3.

Figure 5:
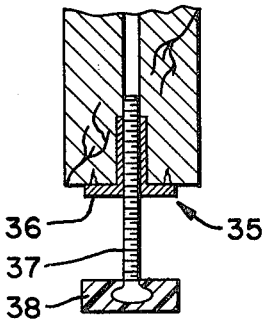
FIG. 5 is an enlarged sectional view taken along line V—V of FIG. 4.

As shown in FIGS. 4 and 5, the sofa-bed frame further includes spaced-apart support assemblies 35 housed by each of the end walls 13 and 14 to contact the floor. Each support assembly includes a threaded sleeve or nut 36 receiving a threaded shaft 37 having a plastic foot member 38 on the projected end to engage the floor. The support assemblies provide vertical adjustment to the height of the sofa cushion 19 in order to provide a method for compensating for differences in the coutour of any finished floor treatment under and in front of sofa frame 10 in its end-use environment. This insures that the top surface of cushion 19 and the top surfaces of bolsters 21 and 22, in an end-to-end relation and resting on the trundle-bed as in FIG. 3, can be adjusted to be coplanar, even when an area rug is used in front of the sofa-bed, for instance. In light of the foregoing, it will be understood by those skilled in the art that the present invention provides an easily assembled/disassembled arrangement of parts that facilitates conversion of a sofa to multiple sleeping surfaces usable simultaneously or as one king-size sleeping surface, or to a sofa and trundle bed usable simultaneously and vice versa with a minimal amount of effort. The invention also utilizes materials and/or processes that require a minimum of capital investment while providing for at least one meaningful alternate use or function for all major components included therein. Raw materials are conserved as well as other precious natural resources related to the manufacture, transport, and end use of the sofa-bed combination.

Figures 1, 2:
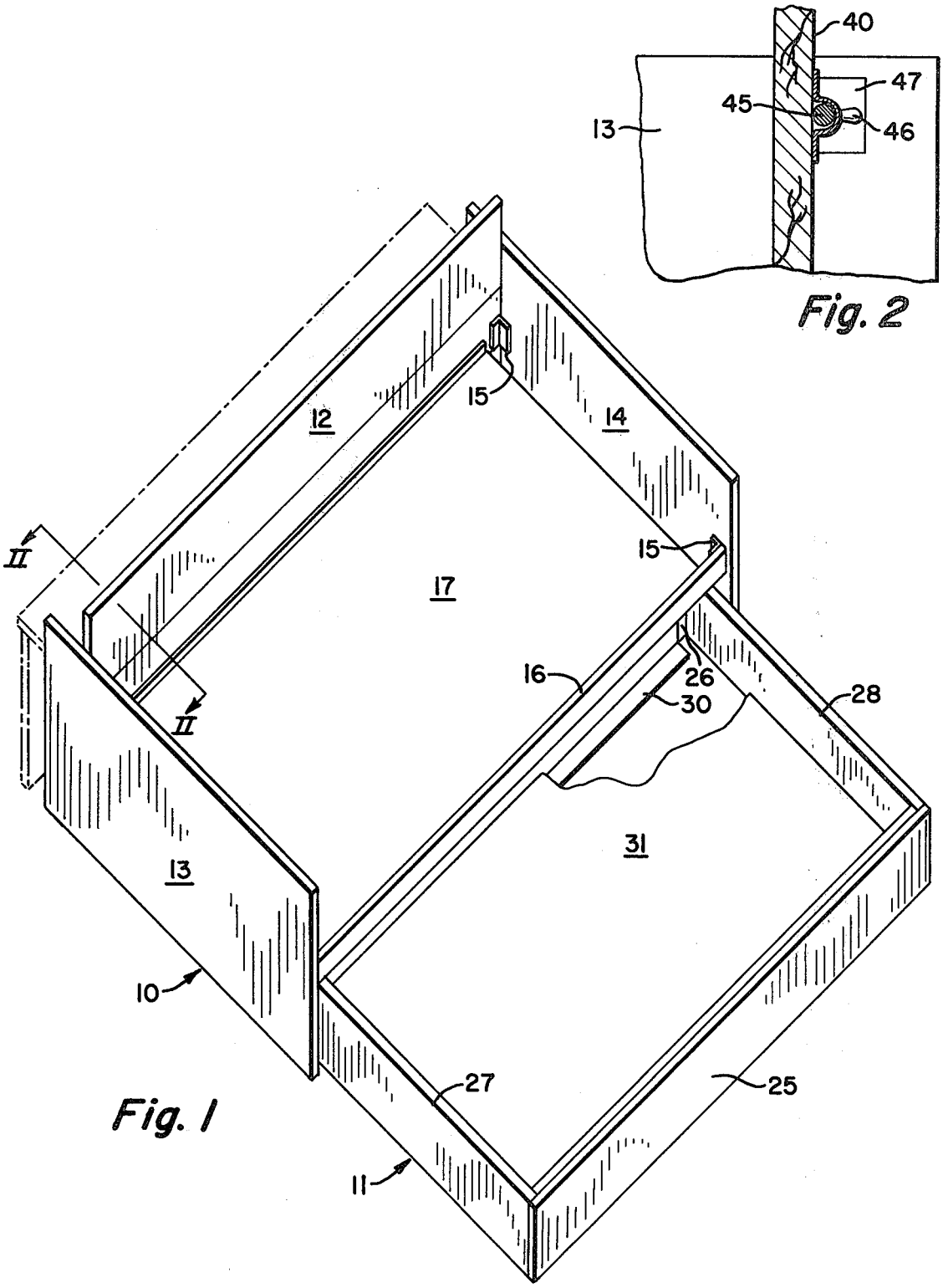
FIG. 1 is an isometric view of a sofa-bed combination according to the embodiment of the present invention not including bolster members.
FIG. 2 is an enlarged sectional view taken along line II—II of FIG. 1.

In accordance with the preferred aspect of the present invention and as shown in FIGS. 1, 3 and 4, the sofa-bed combination is constructed to form a bedside table through subdivision of the back wall 12 along a line forming the upper wall 12 and/or table part 40 that is connected by a hinge 41 to the lower wall 12. Support legs 43 are hinged for support along the upper edge at the normally wall-facing surface of the table part 40 so that when the latter is moved into a horizontal position, the support legs form an effective support therefor. The upper lateral sides of the table part 40 are releasably locked by latch bars 45 (FIG. 2) to provide, when latched, the necessary lateral support for the bolster members in the sofa configuration and, when unlatched, to enable pivotal movement of the table part. The latch bars 45 take the form of slide bolts held by frames to the side of the table part which is opposite to the surface engaged by the bolster member. Outwardly-projecting levers 46 are used to move and retract the bars from aligned drilled openings in rearwardly-projecting portions of walls 13 and 14. These openings are reinforced by recessed catch plates 47. Other forms of latches may be used with equal success.

Although the invention has been shown in connection with a certain specific embodiment, it will be readily apparent to those skilled in the art that various changes in form and arrangement of parts may be made to suit these same requirements without departing from the spirit and scope of the invention.

I claim as my invention:

1. A sofa-bed combination comprising a floor-supported sofa frame including a bolster member support surface adjoined with spaced-apart end walls which are further interconnected by a front crossplate enclosing an area containing cushion support means carried by the sofa frame above the floor, the space between said cushion support means and the floor defining a storage area, a cushion carried by said cushion support means, a floor-supported trundle bed receivable within said storage area for withdrawal therefrom to form a lateral extension of said cushion support means, said trundle bed including a cushion support means and a cushion supported thereby, said cushions being dimensionally equivalent, and two bolster members adapted to form a sofa back cushion by superimposed positioning into a face-to-face arrangement for support by said sofa frame, said two bolster members being dimensioned for side-by-side positioning and support by the cushion support means of the trundle bed upon positioning of said trundle bed to form an extension to the cushion support means of the sofa frame, said bolster members having a thickness which together with the total height of said trundle bed top surface forms a coplanar extension of said cushion to thereby form a bed of essentially standard conventional dimensions and at a conventional height above the floor.

2. The sofa-bed combination according to claim 1 further including hinge means adjoining said bolster members together for superimposed positioning and for said side-by-side positioning upon said bolster support surface for support of the bolster members.

3. The sofa-bed combination according to claim 1 wherein at least one of said bolster members includes an anchor surface to engage said front crossplate.

4. The sofa-bed combination according to claim 1 wherein one of said bolster members includes a tongue section along one edge thereof for receiving said front crossplate.

5. The sofa-bed combination according to claim 4 wherein said cushion carried by said cushion support means is movable for spaced positioning from said front crossplate to abut with one of said bolster members while simultaneously abutting the back to insure fixed positioning.

6. The sofa-bed combination according to claim 1 wherein said bolster members have a thickness greater than the thickness of said cushions.

7. The sofa-bed combination according to claim 6 wherein said bolster members have approximately equal heights.

8. The sofa-bed combination according to claim 1 wherein said trundle bed includes spaced-apart unidirectional wheel support members.

9. The sofa-bed combination according to claim 1 wherein said sofa frame includes adjustable means for vertical height adjustment of said sofa cushion.

10. The sofa-bed combination according to claim 1 wherein said sofa frame further includes means forming a table surface.

11. The sofa-bed combination according to claim 1 wherein said bolster support surface includes a hinged table section, and means to support said table section.

* * * * *